US009630432B2

(12) United States Patent
Conzelmann

(10) Patent No.: US 9,630,432 B2
(45) Date of Patent: Apr. 25, 2017

(54) PRINTER AND PRINT MEDIUM

(71) Applicant: Bizerba GmbH & Co. KG, Balingen (DE)

(72) Inventor: Dieter Conzelmann, Albstadt (DE)

(73) Assignee: Bizerba GmbH & Co. KG (DE)

( * ) Notice: Subject to any disclaimer, the term of this patent is extended or adjusted under 35 U.S.C. 154(b) by 0 days.

(21) Appl. No.: 14/783,909

(22) PCT Filed: Apr. 24, 2014

(86) PCT No.: PCT/EP2014/058315

§ 371 (c)(1),
(2) Date: Oct. 12, 2015

(87) PCT Pub. No.: WO2014/173998

PCT Pub. Date: Oct. 30, 2014

(65) Prior Publication Data

US 2016/0052313 A1 Feb. 25, 2016

(30) Foreign Application Priority Data

Apr. 25, 2013 (DE) ..... 10 2013 007 134

(51) Int. Cl.
*B41J 29/38* (2006.01)
*B41J 3/407* (2006.01)
*B41J 11/00* (2006.01)

(52) U.S. Cl.
CPC ..... *B41J 29/38* (2013.01); *B41J 3/4075* (2013.01); *B41J 11/009* (2013.01)

(58) Field of Classification Search
CPC ..... B41J 29/38; B41J 3/4075; B41J 11/009
See application file for complete search history.

(56) References Cited

U.S. PATENT DOCUMENTS

| | | | | |
|---|---|---|---|---|
| 5,488,223 | A | 1/1996 | Austin et al. | |
| 7,941,238 | B2 | 5/2011 | Storig et al. | |
| 2001/0054642 | A1 | 12/2001 | Landolt et al. | |
| 2002/0163662 | A1 * | 11/2002 | Kaufman | G06K 15/00 358/1.14 |
| 2003/0159603 | A1 * | 8/2003 | Lee | B41J 3/4075 101/228 |

FOREIGN PATENT DOCUMENTS

| | | | | |
|---|---|---|---|---|
| DE | 102006007230 | A1 | 8/2007 | |
| DE | 102008058273 | A1 | 5/2010 | |
| EP | 1164101 | A2 | 12/2001 | |
| JP | 09240121 | A * | 6/1997 | B41J 29/48 |
| JP | H09-240121 | A | 9/1997 | |
| JP | 2007144955 | A | 6/2007 | |

OTHER PUBLICATIONS

International Search Report from International Publication No. PCT/EP2014/058315 mailed Aug. 18 2014.
German Search Report dated Feb. 3, 2014.

* cited by examiner

*Primary Examiner* — Stephen Meier
*Assistant Examiner* — Alexander D Shenderov
(74) *Attorney, Agent, or Firm* — Lerner, David, Littenberg, Krumholz & Mentlik, LLP

(57) ABSTRACT

The invention relates to a printer and a corresponding print medium, wherein the printer reads, by means of a sensor, a code provided on the print medium.
In order to make possible a simplified operation at the same time as an optimal printing result it is provided that data read by means of the sensor are transmitted to a merchandise management system by means of an interface.

13 Claims, 2 Drawing Sheets

PRINTER AND PRINT MEDIUM

CROSS-REFERENCE TO RELATED APPLICATIONS

Figure 1:
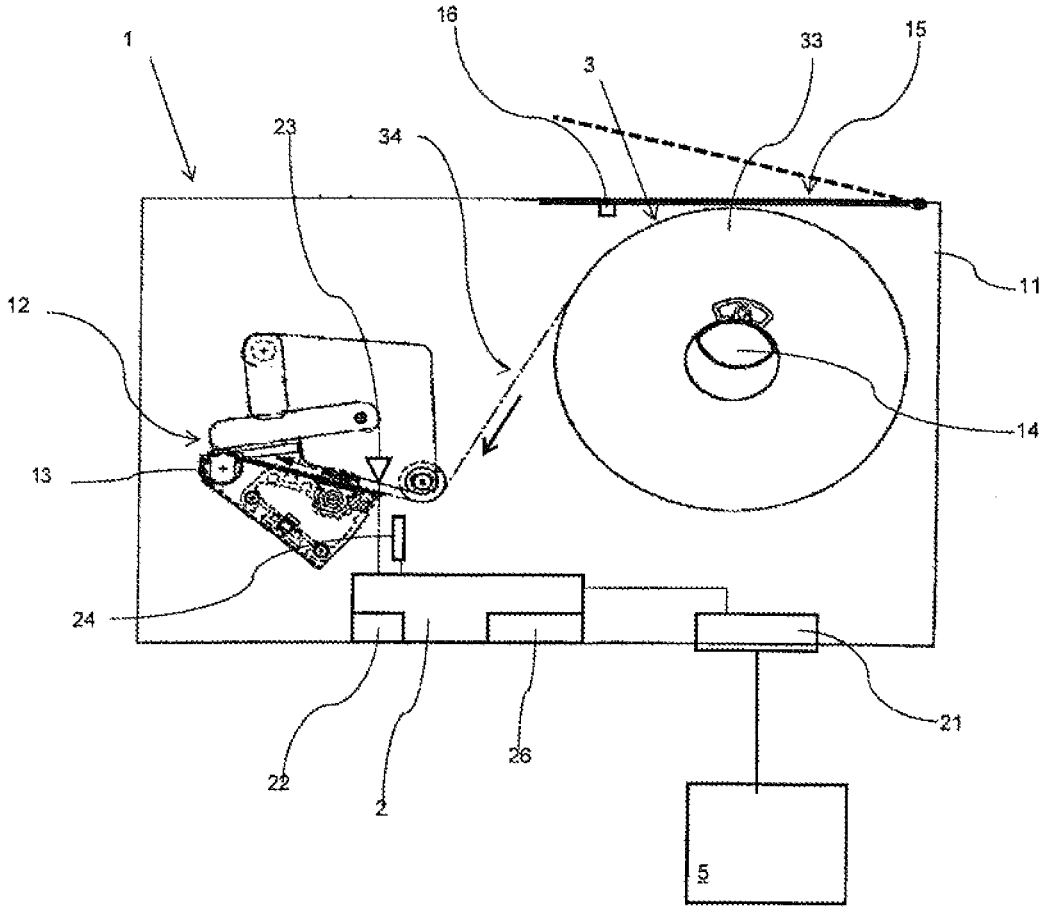

The present application is a national phase entry under 35 U.S.C. §371 of International Application No. PCT/EP2014/058315, filed July Apr. 24, 2014, which claims priority from German Patent Application No. 102013007134.8, filed Apr. 25, 2013; the disclosures of which are incorporated herein by reference.

The invention relates to a printer according to the preamble of claim 1.

Such a printer is known from DE 10 2008 058 273 A1. There, an invisible code is read by means of a sensor in order to control the printer in accordance with the read data. However, it is disadvantageous that, for example, usage data cannot be processed and are no longer available for example after the label roll has been changed.

The object of the invention is to create a printer and a corresponding print medium which in each case make possible an optimal printing result with simplified operation.

This object is achieved according to the invention by a printer according to the features of claim 1.

The printer has a control device with an interface to a merchandise management system. By means of the interface, the control device sends part of the data of a code provided on the print medium, which data are read and extracted by a sensor. For example, the control device can transmit material-specific data or product-specific data to the merchandise management system. By this means, the type of labels used and the mode of operation of the printer can be recorded in a merchandise management system. These data are retained and can be used further even when the print medium is changed. It can also be provided that the data exchange between merchandise management system and control device takes place bidirectionally. For this, the control device can transmit data to the merchandise management system and also receive data from the merchandise management system and thus undertake a data exchange.

As print medium, for example, a receipt roll or a label roll with a backing strip or a label roll without a backing strip can be used. The print medium has a printable side and a reverse side, wherein the code is applied to the reverse side. The code can be formed as a one-dimensional code, in particular a barcode, or as a two-dimensional code, in particular a QR code or Datamatrix code or MaxiCode and is preferably imprinted during the production of the print medium. During the extraction of the data, the control device can read the corresponding code and convert it into a format which the printer or the merchandise management system can understand.

A merchandise management system is a program for managing goods and quantities of goods. In particular, a merchandise management system manages a quantity of goods and can be used for automated ordering. In order to order a print medium which is running low before it has run out, it can be provided that the control device has a meter for recording the print medium used and transmits the usage to the merchandise management system together with the data read by means of the sensor. If a specific amount of a commodity in stock is fallen below, an order transaction can be initiated automatically by the merchandise management system. An automated stock-keeping of the labels can therefore be carried out by means of the merchandise management system. It is thus ensured that there is always a sufficient number of labels in stock.

For automated ordering or improved stock-keeping it is advantageous if the code comprises material-specific data, such as e.g. a manufacturer's number and/or a material number and/or a production date and/or a batch number. On the basis of these material-specific data, the merchandise management system can select and/or order the required type of label.

The merchandise management system can run in a central unit, for example in a server or a mainframe computer, wherein the server or the mainframe computer is connected to the printer and to the interface.

In order to make possible an interruption-free operation of the printer, it can be provided that the control device is formed such that it generates and/or transmits a signal to change the print medium when the amount of the print medium in the printer falls below a certain minimum amount. Thus, the printer indicates in situ when the print medium, or the label roll, is running low. For example, the printer can activate a light signal or send an SMS or an e-mail in order to inform a machine operator, who can then change the print medium or the label roll in time before a stoppage occurs.

In practice it often occurs that only partly-used print media, preferably label rolls or receipt rolls, are exchanged. When such an opened print medium is then re-inserted into the printer, the run length which is still available can be determined only with difficulty. By means of the merchandise management system, the meter reading can be stored together with a print media identification number. When the same print medium is re-inserted, the control device can now receive the usage data and thus control the printer exactly with regard to the remaining amount.

In order to prevent unnecessary read or write operations it is provided that the control device only carries out the read operation as required. A printer flap is provided which must be opened when a print medium is inserted or removed. The printer flap thus covers a print media holder. The control device initiates a read operation of the code data when the printer flap is opened or closed. Since, after this, the print medium remains in the printer until the next time the printer flap is opened, a single read operation on the insertion or removal of the print medium is sufficient.

For a good printing result, as precise a positioning of the print medium as possible relative to the print head is required. For this, a light barrier measures a spacing or an edge of the print medium in order to control the feed motion of the print medium accordingly. For this it is provided that the control device controls the positioning of the print medium relative to the print head by means of a light barrier, wherein the light barrier has a minimum spacing from the sensor of 10 mm in projection transversely with respect to the direction of transport. It has been shown that the code applied to the print medium can have a disadvantageous effect on this measurement process. The code can show through the label paper and thus confuse the light barrier. Therefore, the light barrier is arranged offset relative to the sensor transversely with respect to the direction of transport, wherein a spacing of at least 10 mm has proven to be sufficient.

A particularly good and/or material-protecting printing result is obtained when the code contains print-specific data and the control device controls the print head and/or the feed motion of the print medium in accordance with these print-specific data. Thus the code can contain, for example, details of a maximum print speed and/or an optimal saturation energy and/or a format specification and/or of a surface coating. On the basis of these details, the control device can now optimally control individual print parameters directly or after adjusting the data using an adjustment table.

A use of the printer is intended, for example, as an installed printer in retail scales or as a label printer for a labeling machine.

Further embodiment examples of the invention are represented in the figures and described in the corresponding description.

There are shown in,

FIG. 1: A schematic view of a printer

Figure 2:
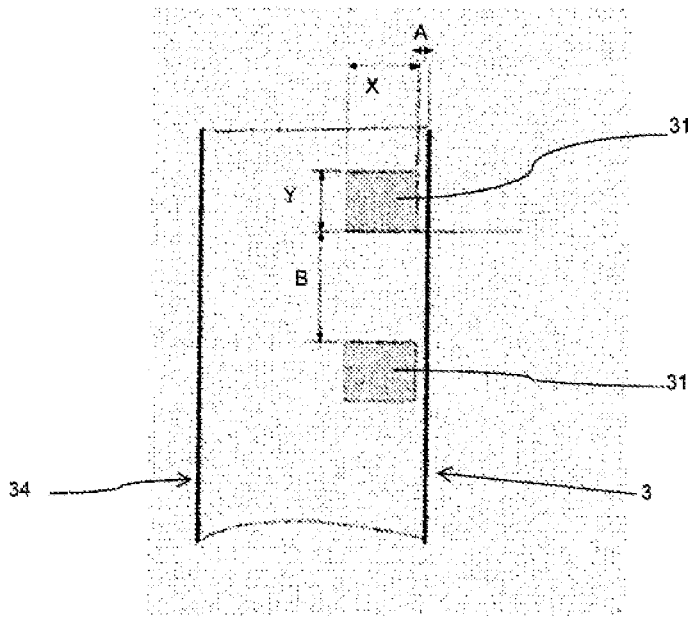

FIG. 2: A schematic view of a label strip

Figure 3:
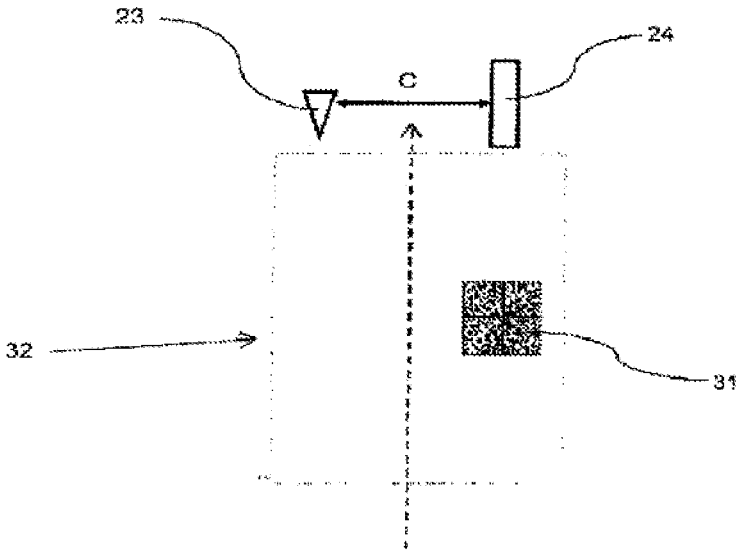

FIG. 3: An individual label with sensor arrangement

In FIG. 1, a schematic side view of a printer 1 is represented. The printer 1 holds a print medium 3 in its housing 11. The print medium 3 can be a receipt roll or a label roll 33 with a backing strip or a label roll without a backing strip. The print medium 33 is held in the printer housing 11 by means of a label holder 14 after a housing flap or printer flap 15 is opened. The printer flap 15 is mounted swivelably on the printer housing 11 and can be pivoted up for the insertion or removal of labels. A contact switch 16 senses the status of the printer flap 15. The contact switch 16 can be formed as a push switch or reed switch.

A label web 34 is released from the label roll 33 and inserted through between a print head 12 and a print roller 13 in the direction of transport. A drive device drives the print roller, which transports the print medium 3 along the print head 12 in the direction of transport during the printing operation. Downstream of the print head 12 a printer outlet is arranged at which the printed labels can be removed. The direction of transport is shown parallel to the label web by means of an arrow. The printer 1 can print the print medium 34 using a direct thermal or thermal transfer process.

A control device 2 is provided in order to control the printer. The control device is connected to a merchandise management system 5 and/or further printers by means of an interface 21. The interface 21 can be formed as a wired, in particular serial interface or as a wireless interface.

The print medium 3 is represented in FIG. 2. It has a pressure-sensitive layer which is printed by the print head 12. The print medium 3 can be formed as a receipt roll or as a label roll. In contrast to a receipt roll, a label roll has an adhesive reverse side. This can be covered by a backing strip. However, the printer 1 can also print labels without a backing strip. For this, the print roller 13 is provided with a non-suck coating such that the adhesive cannot adhere to the print roller 13.

In FIG. 3 an individual label 32 is represented by way of example. It has a 2D code 31 on the reverse side facing away from the pressure-sensitive side. This 2D code 31 is read by a control device 2 by means of a sensor 24. The sensor can, for example, be formed as a scanner which can scan a 2D code while it is stationary or during transport of the labels.

A light barrier 23 is provided in order to be able to carry out an exact positioning of the labels relative to the print head 12. The light barrier 23 can measure in the reflection method or in the transmitted light method and detects an edge of the label 32 by means of a light/dark change.

In order to prevent the 2D code from influencing the light barrier, the light barrier 23 is laterally offset vis-à-vis the sensor 24 by a distance C seen in the direction of transport. The distance C is at least 10 mm long. This corresponds to the minimum spacing between sensor 24 and light barrier 23 in order to prevent mutual influencing. The sensor 24 can be arranged offset to the light barrier 23 in the direction of transport. The distance C is measured in projection transversely with respect to the direction of transport.

As shown in FIG. 3, the measurement sensors are arranged such that the sensor 24 covers one half of a label 32 and the light barrier 23 covers the other half.

The control device 2 is connected to the sensor 24 and the light barrier 23. The control device reads the data of the 2D code by means of the sensor 23 and extracts or decodes them. The printer has an interface 21 by means of which the control device 2 communicates with a merchandise management system 5. The merchandise management system 5 is a program for stock-keeping or for supporting an ordering system and has a goods database in which item-related data are stored and managed.

The code 31 is provided on the reverse side of the print medium 3. The code 31 is designed as a OR code and is already printed onto the reverse side during the production of the print medium 3. The code can be printed onto the reverse side of a receipt roll at a regular spacing B. In the case of a label roll with a backing strip, the code 31 can also be printed onto the reverse side of a backing strip at a regular spacing B. The spacing B is measured such that exactly one code 31 is provided on the reverse side for each label to be printed.

In the case of labels without a backing strip, the code 31 can be printed directly onto the reverse side of the labels. After the printing, the reverse side is coated with an adhesive in order to ensure the self-adhesive properties of the labels. A transparent adhesive is used which allows the code 31 to be scanned even through the adhesive layer.

The code 31 is provided on a side of the print medium 3 with a minimum spacing from its edge of 4 mm. This spacing has the effect that the code is readable even if the edge of the print medium 3 is damaged due to mechanical loading.

The dimensions in the X and Y direction of the rectangular or square 2D code 31 are preferably in a range of from 8 mm to 25 mm. This range represents an optimal compromise between an optical impairment of the label and the readability of the code 31.

The merchandise management system 5 can be installed on an external server which is physically separated from the printer. However, the merchandise management system can also be installed on an operating terminal which is connected to the printer and which is physically assigned to the printer 1.

The 2D code contains material-specific data. These material-specific data comprise a manufacturer's number and/or a material number or a PLU and/or a batch number and/or a production date. An effective transfer of data results as the data format of the 2D code first contains a manufacturer's number and then the material number or the PLU and both numbers have 13 digits, i.e. are designed with 13 decimal places.

The production date and the batch number both have 8 digits, i.e. are each designed with 8 decimal places.

In addition, the 2D code contains a print media identification, that is a number which explicitly identifies a specific print medium or an individual receipt roll or label roll. The print media identification is formed as a consecutive number with 8 or 9 or 10 decimal places. Together with the production date and/or the batch number, a specific print medium can thus be explicitly identified.

Furthermore, the 2D code also comprises print-specific data. These print-specific data comprise a maximum print speed and/or an optimal saturation energy and/or a format specification and/or details of a surface coating. On the basis of the print-specific data, the control equipment 2 can control the printer 1, in particular the print head 12 and/or the print roller 13 such that the print quality is optimized.

The format of the print-specific data comprises a maximum print speed with 3 decimal places as well as optimal saturation energy with 2 decimal places. A surface coating can be specified with 1 decimal place.

After the insertion of a print medium 33 and the closure of the printer flap 15, the contact switch 16 reports this to the control device 2. This will then read the 2D code and extract the contained data. The control device 2 transmits some of the read data to the merchandise management system 5. The latter stores the data in order to enable stock-keeping.

For this, the merchandise management system 5 has an item-specific database which comprises for each type of label a manufacturer's number and a material number and a batch number and/or a production date. For these data, the saving format of the merchandise management system corresponds to the saving format of the 2D code.

Thus, the saving format of the merchandise management system 5 has a 13-digit manufacturer's number and a 13-digit material number and an 8-digit batch number and/or the 8-digit production date.

The control device 2 has a meter 22 which counts the number of used tickets or running meters of label strip.

As labels 33 are inserted and/or removed, data of the 2D code, in particular a print media identification, are transferred together with the usage level to the merchandise management system and stored there, or are transferred from the merchandise management system 5 to the control device 2. Therefore, the current information about the number of labels for each print medium or running meters of labels is always available in the control device 2. Using this information, the control device 2 is always capable of transmitting a signal to change the print medium in time in order to prevent no-load running.

In addition, in an embodiment it is provided that the merchandise management system transfers print media-specific data, such as e.g. possible layouts, or format details, or print speeds to the printer 1 or the control device 2. On the basis of these details, in particular together with the read data of the 2D code, the control device 2 automatically sets a specific print mode.

The control device 2 has a memory 26 in which various print layouts are stored. The print layouts can already be stored pre-configured in the memory 26 or be loaded into the memory 26 by means of the serial interface 21. As labels are inserted, the control device 2 reads out the 13-digit material number or PLU of the 2D code 31. This material number or PLU explicitly identifies an item or a type of label. On the basis of this material number, the control device 2 then selects the layout belonging to this item from the memory 26 and uses this as the print image for the label.

In addition, the control device carries out a plausibility check. For example, the control device 2 can compare the data of the label format stored in the 2D code with the data of the print layout. In the case of discrepancies between the data, the control device 2 issues an error message or stops the printing operation. In this way, the mechanism of the printer 1 is largely automated and misprints can be prevented.

The invention claimed is:

1. Printer which prints a strip-shaped print medium by means of a print head, the printer comprising:

a control device that controls the print head and is connected to a sensor to read a code provided on the print medium and extracts the code data contained in the code, wherein the control device has an interface and is connected by the interface to a merchandise management system and transmits at least part of the code data to the merchandise management system, wherein the code comprises material-specific data including at least one of a manufacturer's number, a batch number, a production date or a material number.

2. Printer according to claim 1, wherein the control device has a meter for recording the print medium used and transmits usage together with data read by the sensor to the merchandise management system.

3. Printer according to claim 2, wherein the control device is formed to at least one of generate or transmit a signal to change the print medium if an amount of the print medium in the printer falls below a certain minimum amount.

4. Printer according to claim 1, wherein the merchandise management system is formed to at least one of automatically initiate or carry out an order transaction as soon as the remaining print medium remaining falls below a specific amount.

5. Printer according to claim 1, further comprising:

a printer flap for covering a print media holder, and wherein the control device reads the code data by means of the sensor when the printer flap is opened or closed.

6. Printer according to claim 1, wherein the control device controls positioning of the print medium relative to the print head by means of a light barrier, wherein the light barrier has a minimum spacing (C) from the sensor of 10 mm in a projection transversely with respect to a direction of transport.

7. Printer according to claim 1, wherein the control device controls at least one of saturation of the print head or rate of feed of the print medium on the basis of the code data.

8. Printer according to claim 1, wherein the control device has a memory with several item-specific print layouts and selects a specific print layout from the memory on the basis of the code data.

9. Method for controlling a printer which prints to a strip-shaped print medium by means of a print head, the printer including a control device that controls the print head, is connected to a sensor to read a code provided on the print medium and extracts the code data contained in the code, the method comprising:

after insertion of the print medium, the printer reads data provided on the print medium and transmits the data to a merchandise management system, wherein the code comprises material-specific data including at least one of a manufacturer's number, a batch number, a production date or a material number.

10. Method according to claim 9, wherein the transmitted data are stored in the merchandise management system in a print media-specific database.

11. Method according to claim 9, wherein, on the basis of the transmitted data, an item of print media-specific information including at least one of a remaining residual amount of print media, or a print format or a print layout is selected from a database of the merchandise management system and sent back to the printer.

12. Method according to claim 11, wherein at least one of (i) a specific print mode is set in the printer on the basis of the read data and the received data or (ii) a plausibility test is carried out.

13. Method according to claim 11, wherein an order is initiated by the merchandise management system when a remaining residual amount of print media reaches or falls below a specific amount.

* * * * *